US007654876B1

(12) United States Patent
Jones et al.

(10) Patent No.: US 7,654,876 B1
(45) Date of Patent: Feb. 2, 2010

(54) AFTERMARKET SUPERCHARGER FOR PERSONAL WATERCRAFT

(75) Inventors: Daniel W. Jones, Lenexa, KS (US); Ty W. Clark, Wakarusa, KS (US)

(73) Assignee: Accessible Technologies, Inc., Lenexa, KS (US)

( * ) Notice: Subject to any disclaimer, the term of this patent is extended or adjusted under 35 U.S.C. 154(b) by 152 days.

(21) Appl. No.: 11/419,711

(22) Filed: May 22, 2006

Related U.S. Application Data

(60) Provisional application No. 60/682,890, filed on May 20, 2005.

(51) Int. Cl.

| | |
|---|---|
| ***F02B 61/04*** | (2006.01) |
| ***F02B 33/00*** | (2006.01) |
| ***F02M 35/16*** | (2006.01) |
| ***B63B 35/73*** | (2006.01) |
| ***B63H 21/30*** | (2006.01) |

(52) U.S. Cl. ..... 440/88 A; 440/111; 123/559.1

(58) Field of Classification Search ..... 440/88 A, 440/111; 123/559.1–559.3

See application file for complete search history.

(56) References Cited

U.S. PATENT DOCUMENTS

| | | | | | |
|---|---|---|---|---|---|
| 1,754,724 | A | * | 4/1930 | Mead | 123/559.1 |
| 1,951,045 | A | * | 3/1934 | Willgoos | 123/559.3 |
| 2,082,556 | A | * | 6/1937 | Smith et al. | 123/561 |
| 2,127,460 | A | * | 8/1938 | Chilton | 123/559.1 |
| 2,255,424 | A | * | 9/1941 | Jandasek | 123/559.3 |
| 2,333,150 | A | * | 11/1943 | Bowen | 123/559.1 |
| 2,350,616 | A | * | 6/1944 | Johnson | 415/204 |
| 2,581,834 | A | * | 1/1952 | Brown | 415/122.1 |
| 2,695,131 | A | * | 11/1954 | Price | 415/122.1 |
| 3,391,753 | A | * | 7/1968 | Anderson | 180/307 |
| 3,418,986 | A | * | 12/1968 | Scherenberg | 123/559.1 |
| 4,332,521 | A | * | 6/1982 | Erickson | 415/89 |
| 4,969,805 | A | * | 11/1990 | Romeo | 417/407 |
| 5,224,459 | A | * | 7/1993 | Middlebrook | 123/559.1 |
| 5,535,601 | A | * | 7/1996 | Teraoka | 62/402 |
| 5,893,355 | A | * | 4/1999 | Glover et al. | 123/559.1 |
| 6,192,871 | B1 | * | 2/2001 | Middlebrook | 123/559.1 |
| 6,293,263 | B1 | * | 9/2001 | Middlebrook | 123/559.1 |

(Continued)

FOREIGN PATENT DOCUMENTS

| | | | |
|---|---|---|---|
| JP | 05106457 | A * | 4/1993 |

(Continued)

*Primary Examiner*—Thai Ba Trieu
(74) *Attorney, Agent, or Firm*—Hovey Williams LLP

(57) ABSTRACT

A personal watercraft is disclosed as including an engine and a forced air induction system including an aftermarket supercharger. The aftermarket supercharger replaces the personal watercraft's original-equipment supercharger and increases the charge of compressed air provided to the engine. The preferred supercharger incorporates a spur gear that includes a smaller pitch diameter than the original-equipment supercharger. The smaller spur gear and engine flywheel thereby provide an increased gear ratio and permit greater supercharger rotational speeds when compared with the original supercharged engine. In order to permit intermeshing engagement with the engine flywheel, the spur gear is axially offset from the original spur gear axis. However, the supercharger case maintains the same engine-mating surface as the original-equipment supercharger so that the case may be received within a complemental socket of the engine housing. Other embodiments relate to aspects of the invention applicable to original equipment and other internal combustion engine applications.

19 Claims, 11 Drawing Sheets

U.S. PATENT DOCUMENTS

| | | | | |
|---|---|---|---|---|
| 6,378,309 | B1 * | 4/2002 | Divecha et al. | 60/612 |
| 6,415,759 | B2 | 7/2002 | Ohrnberger et al. | 123/195 A |
| 6,439,208 | B1 | 8/2002 | Jones | 123/559.1 |
| 6,478,469 | B1 | 11/2002 | Jones | 384/461 |
| 6,568,376 | B2 * | 5/2003 | Sonnleitner et al. | 123/559.1 |
| 6,626,140 | B2 * | 9/2003 | Aichinger et al. | 440/12.5 |
| 6,655,307 | B2 * | 12/2003 | Gokan | 123/559.1 |
| 6,676,464 | B2 * | 1/2004 | Gokan et al. | 440/88 D |
| 6,918,804 | B2 * | 7/2005 | Matsuda | 440/88 A |
| 6,941,926 | B2 * | 9/2005 | Fagala | 123/566 |
| 7,051,824 | B1 | 5/2006 | Jones et al. | 180/68.3 |
| 7,168,998 | B1 | 1/2007 | Jones et al. | 440/88 A |
| 2001/0042532 | A1 * | 11/2001 | Aichinger et al. | 440/84 |
| 2001/0052340 | A1 * | 12/2001 | Sonnleitner et al. | 123/564 |
| 2004/0255917 | A1 * | 12/2004 | Mokry | 123/559.1 |
| 2005/0028795 | A1 * | 2/2005 | Benson | 123/559.1 |
| 2007/0062498 | A1 * | 3/2007 | Woods | 123/559.1 |
| 2007/0209611 | A1 * | 9/2007 | Buck | 123/41.31 |

FOREIGN PATENT DOCUMENTS

| | | | |
|---|---|---|---|
| JP | 2007085284 | A * | 4/2007 |

* cited by examiner

AFTERMARKET SUPERCHARGER FOR PERSONAL WATERCRAFT

RELATED APPLICATION

This application claims the priority of Provisional Application Ser. No. 60/682,890, filed May 20, 2005, entitled AFTERMARKET SUPERCHARGER FOR PERSONAL WATERCRAFT, which is hereby incorporated by reference herein.

BACKGROUND OF THE INVENTION

1. Field of the Invention

The present invention relates generally to supercharged engines. More specifically, the present invention concerns a supercharged engine with an aftermarket supercharger that replaces the original-equipment supercharger, which is preferably designed for use in a personal watercraft.

2. Discussion of Prior Art

Supercharged engines, with forced air induction systems installed either as original equipment or as aftermarket equipment, are well known in the art. Such prior art engines commonly include limited mounting locations for the supercharger. For example, turning to FIGS. 2, 4, 4*a*, and 8*a*, a prior art supercharged engine SE is illustrated that presents a single mounting location that is also non-adjustable. The illustrated supercharged engine SE is incorporated into a SEA-DOO® personal watercraft, manufactured by Bombardier Recreational Products, Inc., Quebec, Canada. The supercharged engine SE includes an engine E and a supercharger SC. The engine E includes the mounting location that receives and supports the supercharger SC. Referring to FIGS. 4 and 4*a*, these figures are conceptual drawings that represent Applicants' understanding of the prior art, and it is particularly noted that the prior art construction may actually vary slightly from Applicants' understanding.

Supercharged engines and aftermarket superchargers are problematic and suffer from certain limitations. Prior art supercharged engines are not designed to take advantage of recent supercharger technology improvements, particularly those improvements introduced by the Assignee of the present application. Such improvements permit the supercharger compression element of a supercharger to safely and reliably spin at much greater rotational speeds than the superchargers installed on the prior art supercharged engines. Additionally, prior art vehicle and supercharged engine configurations include power-take-off mechanisms and present supercharger mounting configurations that typically restrict or preclude the replacement of the original-equipment supercharger with aftermarket superchargers. Furthermore, conventional techniques for installing aftermarket superchargers, e.g., chain or belt drives, are particularly deficient where the engine and supercharger are drivingly interconnected by a gear drive and the surrounding structure prevents the installation of conventional belt or chain drives. Therefore, the conventional techniques do not permit the addition of aftermarket superchargers that provide greater rotational speeds than original-equipment superchargers.

SUMMARY OF THE INVENTION

The present invention provides a forced air induction system that does not suffer from the problems and limitations of prior art systems set forth above.

A first aspect of the present invention concern a powered vehicle including a supercharged engine originally designed to include an original-equipment supercharger, wherein the original equipment supercharger includes an original input gear drivingly connected to a drive gear driven by the engine, with the gears cooperatively presenting an original gear ratio. Moreover, the invention concerns an aftermarket supercharger retrofitted onto the engine to thereby replace the original-equipment supercharger. The aftermarket supercharger broadly includes a case and a rotatable shaft. The case presents a compressor chamber. The rotatable shaft is supported on the case and carries an aftermarket input gear drivingly connected to the drive gear. The aftermarket input gear includes a smaller pitch diameter than the original input gear so that the aftermarket input gear cooperates with the drive gear to present a modified gear ratio larger than the original gear ratio.

A second aspect of the present invention concerns a powered vehicle including a supercharged engine originally designed to include an original-equipment supercharger, with the engine including a mounting socket that presents a socket central axis and receives an original projection of the original-equipment supercharger, wherein the original equipment supercharger includes an original driven element presenting an original element axis and being drivingly connected to a drive element mounted on a crankshaft of the engine, with the elements cooperatively presenting an original diameter ratio and the axes being at least substantially aligned. Moreover, the present invention concerns an aftermarket supercharger retrofitted onto the engine to thereby replace the original-equipment supercharger. The aftermarket supercharger broadly includes a case and a rotatable shaft. The case presents a compressor chamber and includes an aftermarket projection received within the mounting socket of the engine. The rotatable shaft is supported on the case and carries an aftermarket driven element drivingly connected to the drive element of the engine. The aftermarket driven element includes a smaller diameter than the original driven element so that the aftermarket driven element cooperates with the drive element of the engine to present a modified diameter ratio larger than the original diameter ratio. The shaft and aftermarket driven element being rotatable about an aftermarket element axis that is offset relative to the socket central axis.

A third aspect of the present invention concerns a method of supercharging an engine of a powered vehicle. The method includes the step of removing an original-equipment supercharger from the engine, wherein the original-equipment supercharger has an input element operable to be driven by an engine drive element, with the elements defining an original diameter ratio. The method further includes the step of installing an aftermarket supercharger on the engine, wherein the aftermarket supercharger has an input element operable to be driven by the engine drive element, with the aftermarket input element and engine drive element defining an aftermarket diameter ratio, and wherein the aftermarket input element is smaller than the original-equipment input element so that the aftermarket diameter ratio is larger than the original diameter ratio.

A fourth aspect of the present invention concerns an aftermarket supercharger for a powered vehicle having an engine that includes a drive element and presents a mounting socket defining a socket central axis. The aftermarket supercharger broadly includes a case and a rotatable shaft. The case presents a compressor chamber and includes a projection configured for receipt within the mounting socket of the engine. The projection presents an outer surface that defines a projection central axis configured to be aligned with the socket central axis when the projection is received in the socket. The rotatable shaft is supported on the case and carries a driven element drivingly connectable to the drive element of the engine. The shaft and driven element being rotatable about an element axis that is offset relative to the projection central axis.

A fifth aspect of the present invention concerns a personal watercraft broadly including a buoyant hull, an engine, and a supercharger. The buoyant hull is configured to support at least one rider thereon and defines an interior space. The engine includes an intake and a supercharger mounting socket. The engine is mounted within the interior space. The supercharger is mounted to the engine for providing supercharged induction fluid to the intake. The supercharger broadly includes a case, a rotatable compression member, and a step-up transmission. The case presents a compressor chamber and a transmission chamber. The case includes a projection received within the supercharger mounting socket. The rotatable compression member is located within the compressor chamber. The step-up transmission is located at least partly within the transmission chamber and includes a rotatable input shaft, a rotatable compression member shaft with the compression member mounted thereon, a drive element associated with the input shaft, and a driven element associated with the compression member shaft. The shafts are supported on the case. The drive element has a larger diameter than the driven element, with the relative diameters defining a diameter ratio of the step-up transmission.

A sixth aspect of the present invention concerns a method of supercharging an engine of a powered vehicle. The method includes the step of replacing a transmissionless supercharger with an aftermarket supercharger that includes an internal step-up transmission.

A seventh aspect of the present invention concerns a personal watercraft broadly including a buoyant hull, an engine, and a supercharger. The buoyant hull is configured to support at least one rider thereon and defines an interior space. The engine includes an intake and a supercharger mounting socket. The engine is mounted within the interior space. The supercharger is operable to supply supercharged induction fluid to the intake. The supercharger broadly includes a case, a rotatable compression member, and a rigid, integral bracket. The case presents a compressor chamber and includes a projection received within the mounting socket. The rotatable compression member is within the compressor chamber. The rigid, integral bracket presents opposite first and second ends and a central elongated section therebetween. The first end of the bracket is fixed relative to the engine. The second end of the bracket is fixed to the case at an attachment location spaced from the projection, with the central section configured to be spaced from the engine and the case portion.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
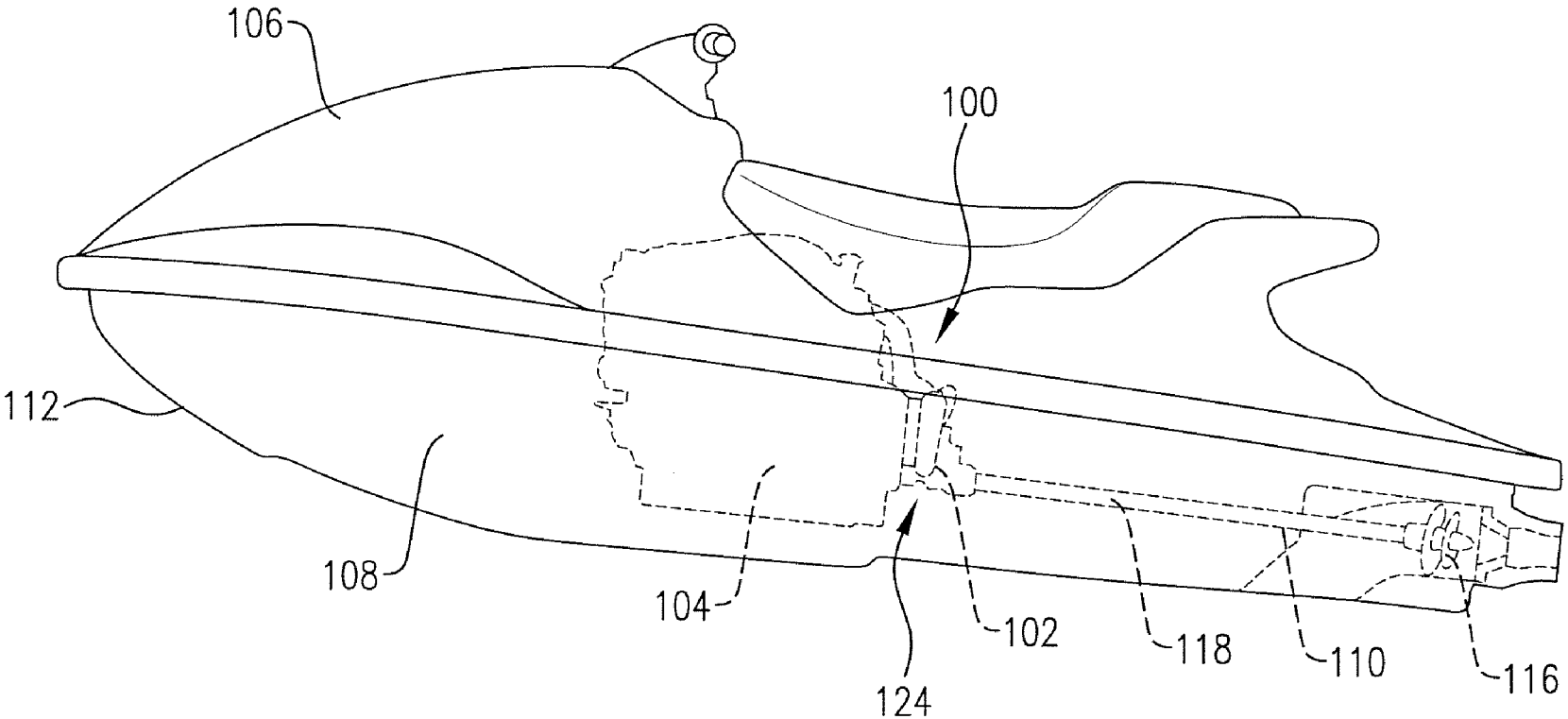
FIG. 1 is a side view of a personal watercraft including a supercharged engine constructed in accordance with a preferred embodiment of the present invention.
Figure 2:
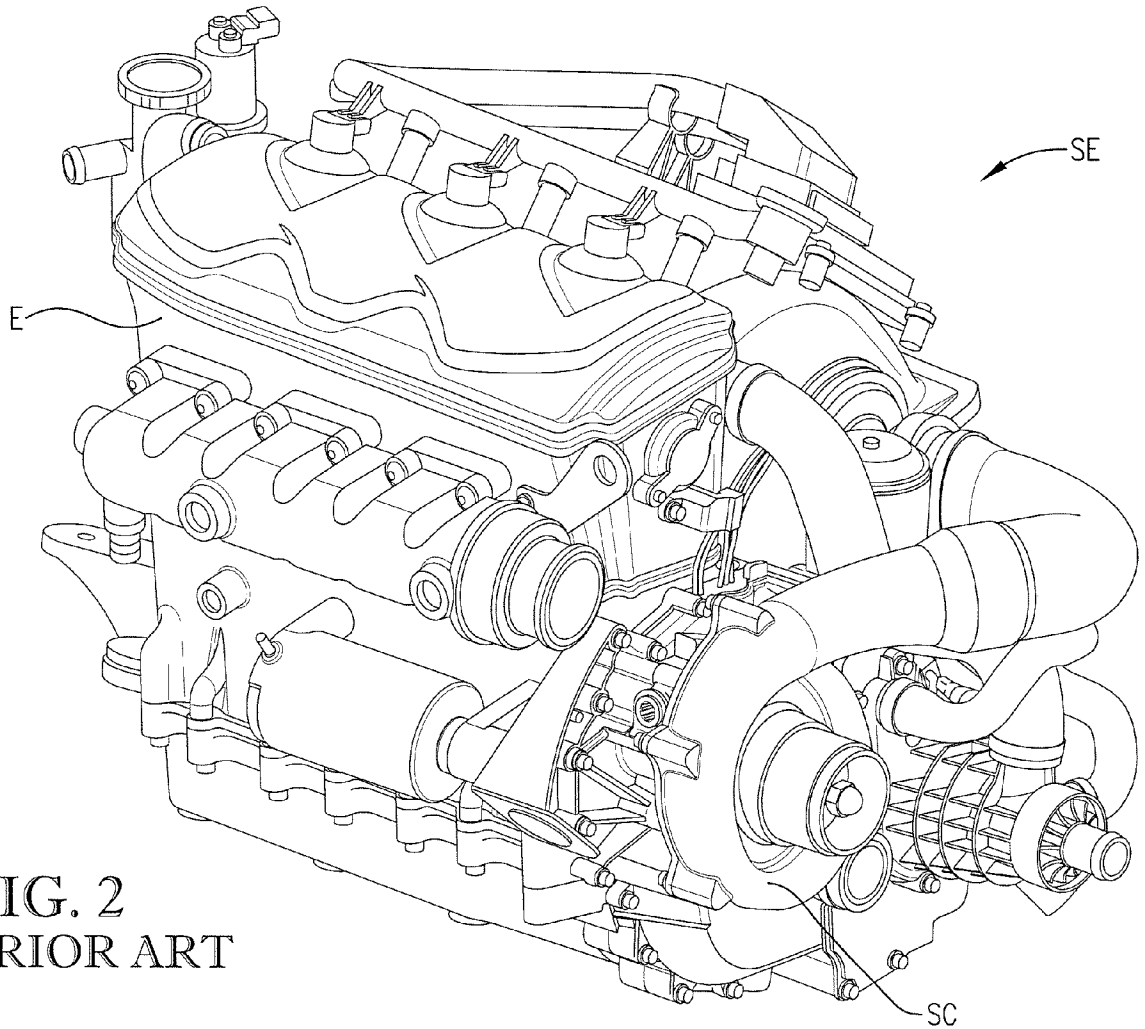
FIG. 2 PRIOR ART
FIG. 2 is a fragmentary rearward perspective view of a prior art personal watercraft showing a prior art supercharged engine.
Figure 3:
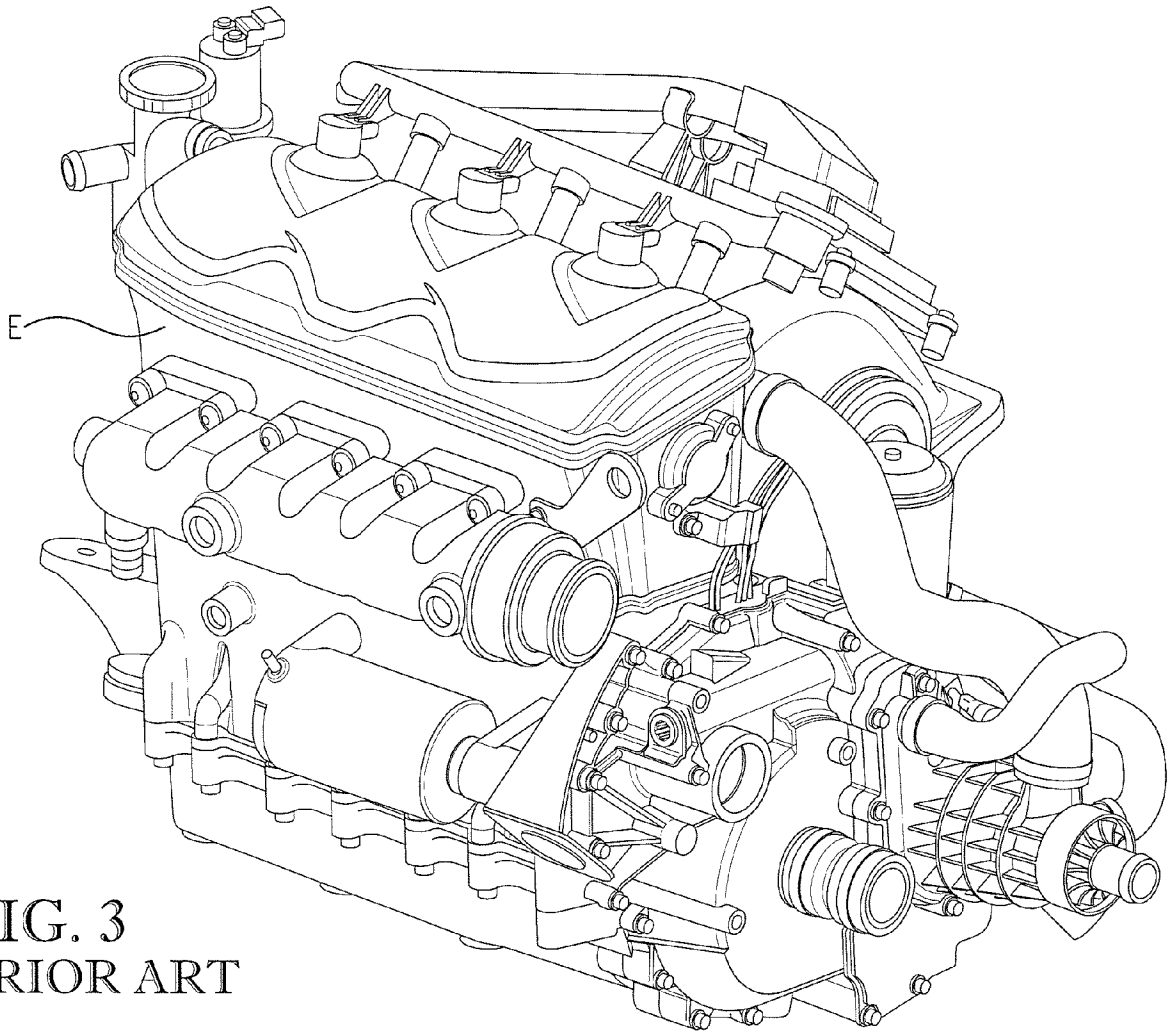
FIG. 3 PRIOR ART
FIG. 3 is a fragmentary rearward perspective view of the prior art personal watercraft shown in FIG. 2, showing the prior art engine with the supercharger removed from the engine.
Figure 4:
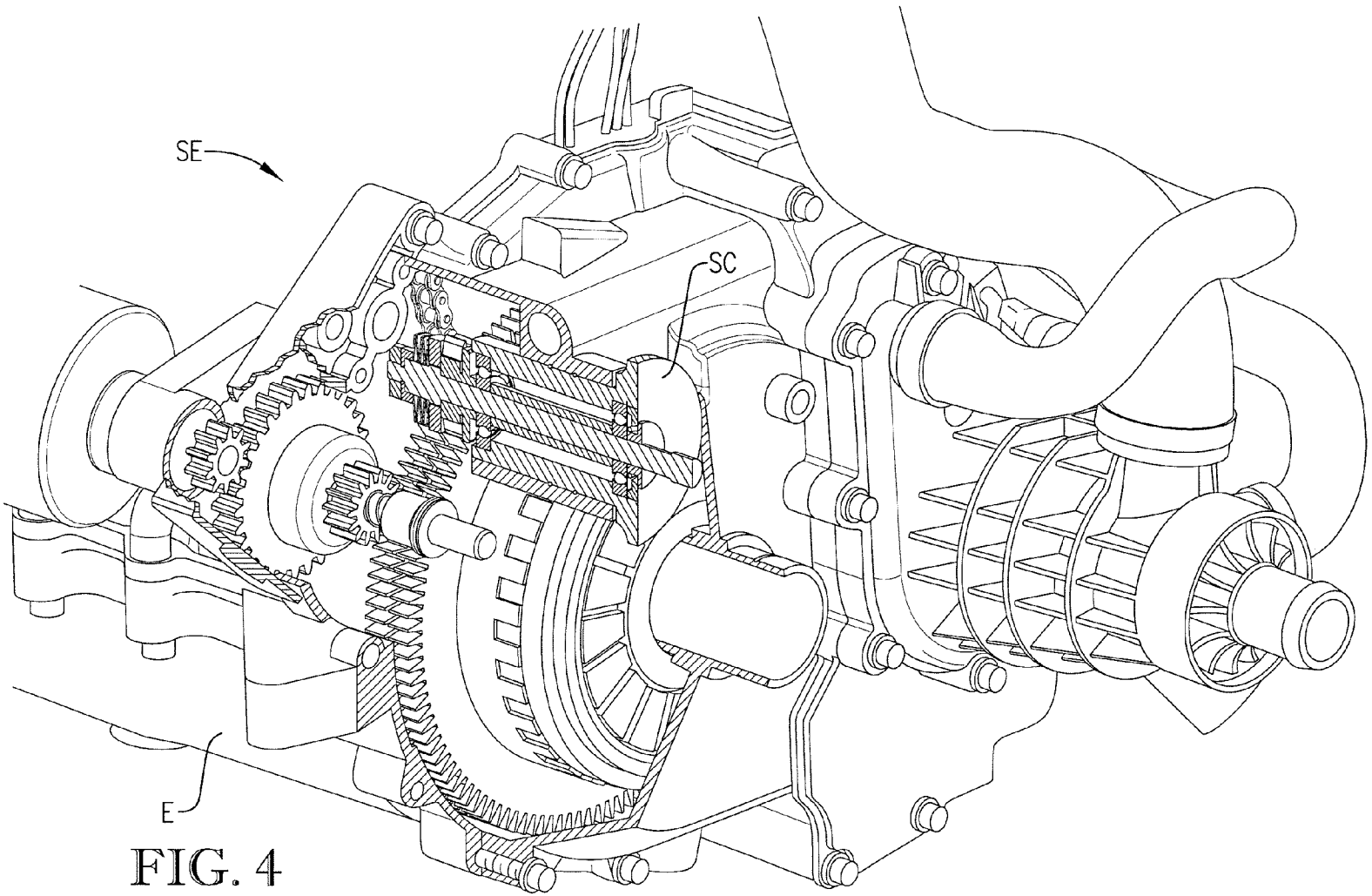
FIG. 4 PRIOR ART
FIG. 4 is an enlarged, fragmentary rearward perspective view of the prior art engine as shown in FIG. 2, with the engine housing and supercharger cross-sectioned to illustrate the relative positioning of the supercharger and engine.
Figure 6A:
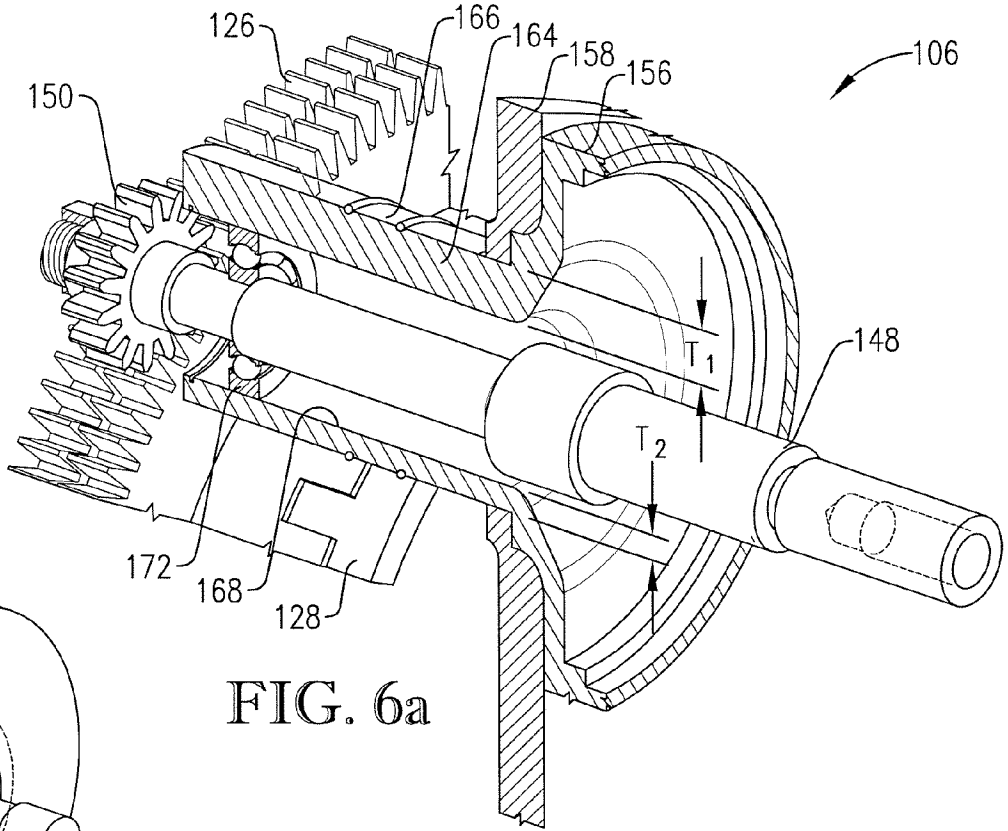
Figure 4A:
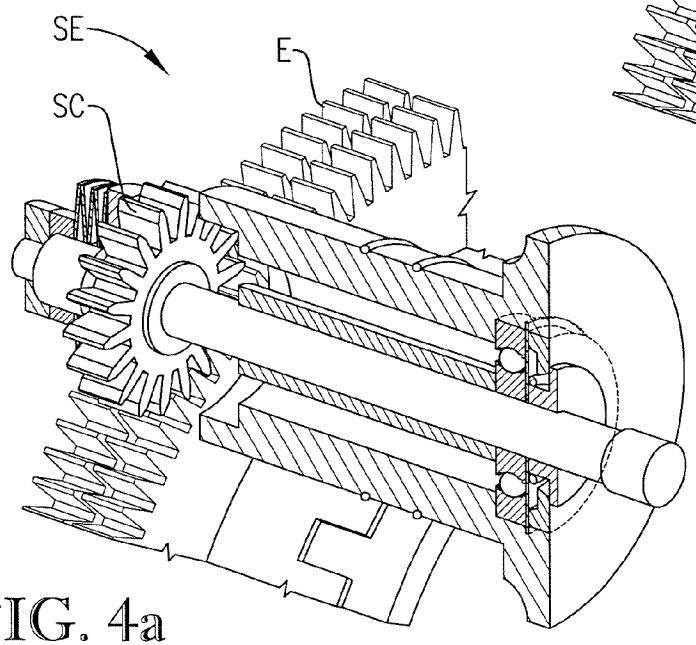
FIG. 4a PRIOR ART
Figure 5:
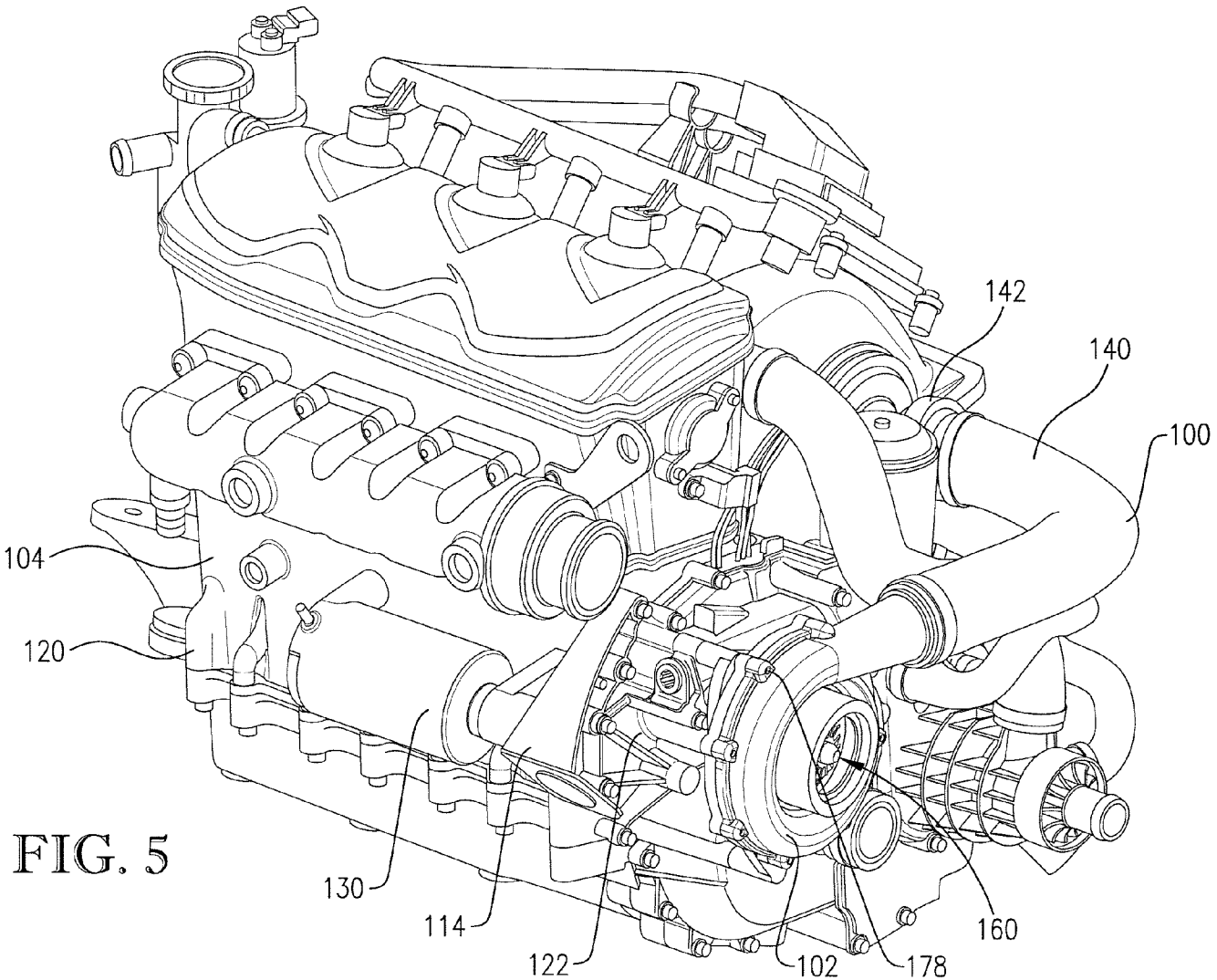
Figure 6:
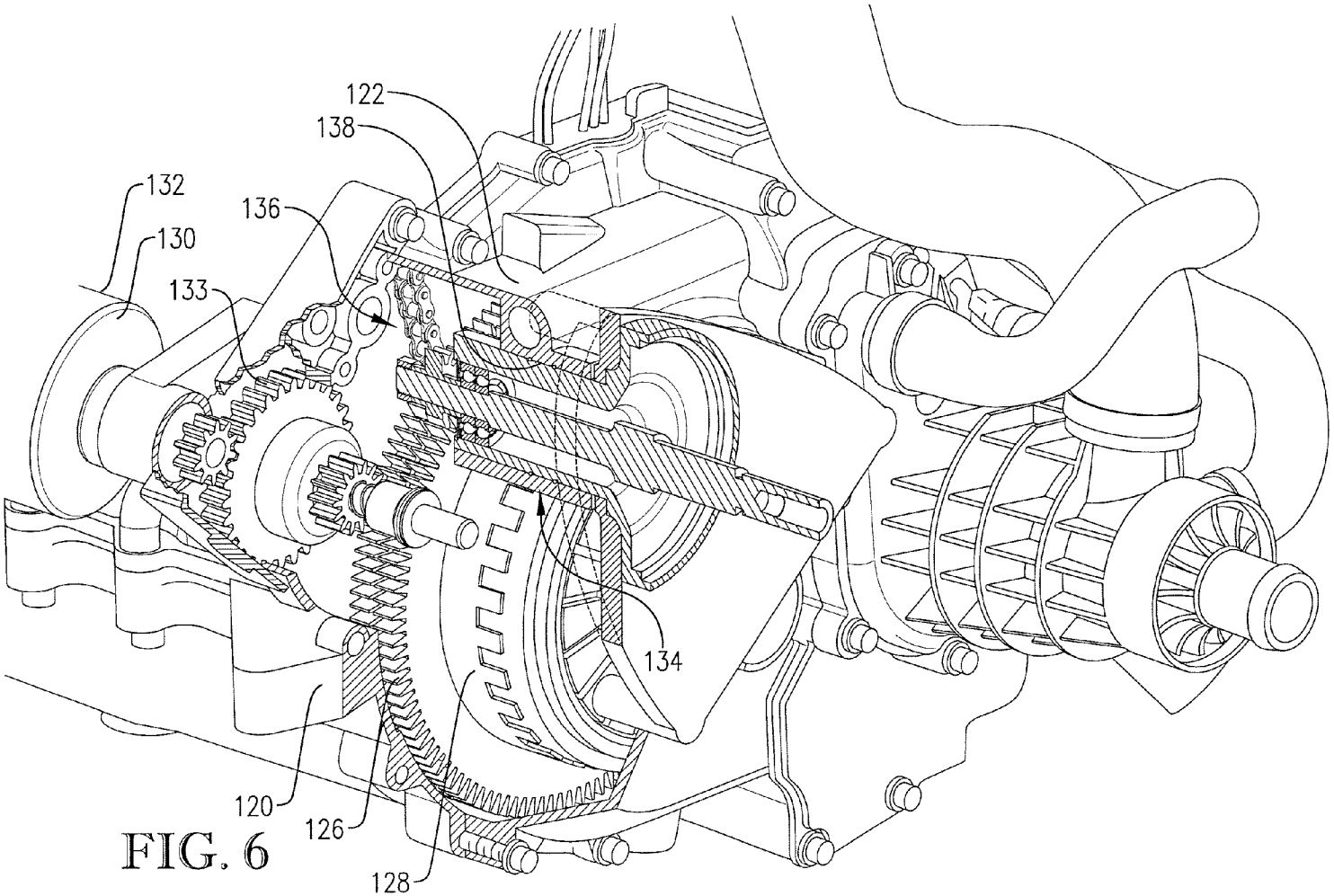
Figure 7:
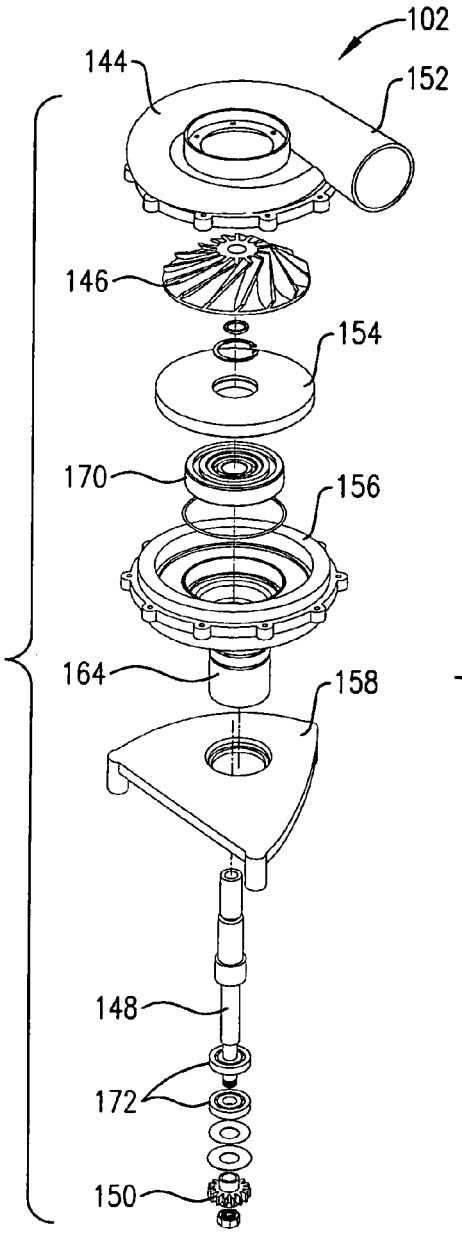

FIG. 4*a* is a further enlarged, fragmentary rearward perspective view of the prior art engine as shown in FIGS. 2-4, showing the supercharger's spur gear intermeshing with the engine's flywheel;

FIG. 5 is a fragmentary rearward perspective view of the preferred personal watercraft shown in FIG. 1, showing the preferred supercharged engine with a preferred supercharger mounted thereon;

FIG. 6 is an enlarged, fragmentary rearward perspective view of the supercharged engine as shown in FIGS. 1 and 5, with the power-take-off housing and the supercharger cross-sectioned to illustrate the relative positioning of the supercharger case within a power-take-off housing of the engine, the relative positioning of the supercharger input gear and supercharger case, and the intermeshing relationship of the input gear and the flywheel ring gear;

FIG. 6*a* is a further enlarged, fragmentary rearward perspective view of the supercharged engine as shown in FIGS. 1, 5, and 6, showing the input gear intermeshing with the engine's flywheel ring gear;

FIG. 7 is an exploded view of the supercharger shown in FIGS. 5, 6, and 6*a;*

Figures 8A, 8B, 9:
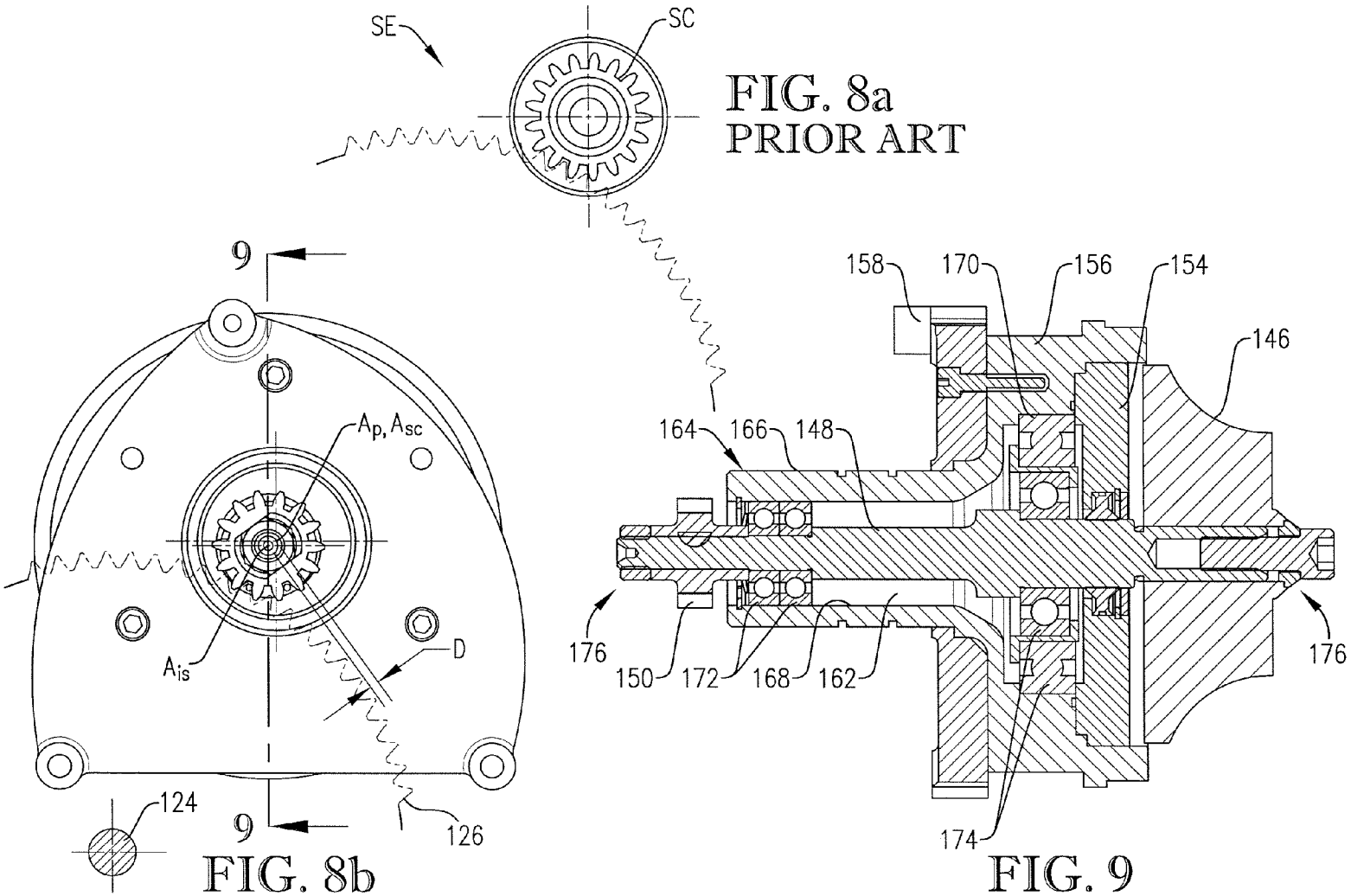
FIG. 8a PRIOR ART

FIG. 8*a* is a fragmentary elevational view of the prior art supercharged engine shown in FIGS. 2-4*a,* showing the intermeshing position of the input gear and flywheel ring gear;

FIG. 8*b* is a fragmentary elevation view of the preferred supercharged engine shown in FIGS. 5-6*a,* showing the axially offset relationship of the supercharger input gear and the supercharger case projection, and the intermeshing position of the input gear and the flywheel ring gear;

FIG. 9 is a fragmentary cross-sectional view of the supercharger taken along line 9-9 in FIG. 8*b;*

Figure 10:
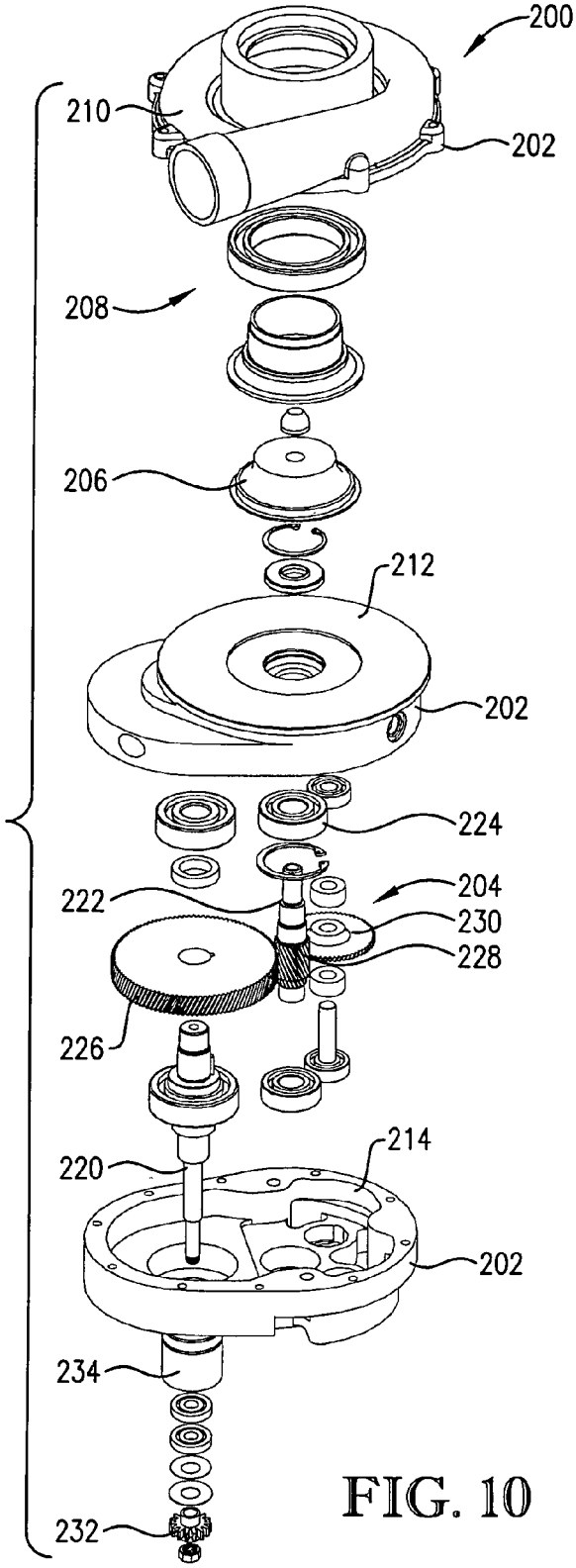
Figure 11:
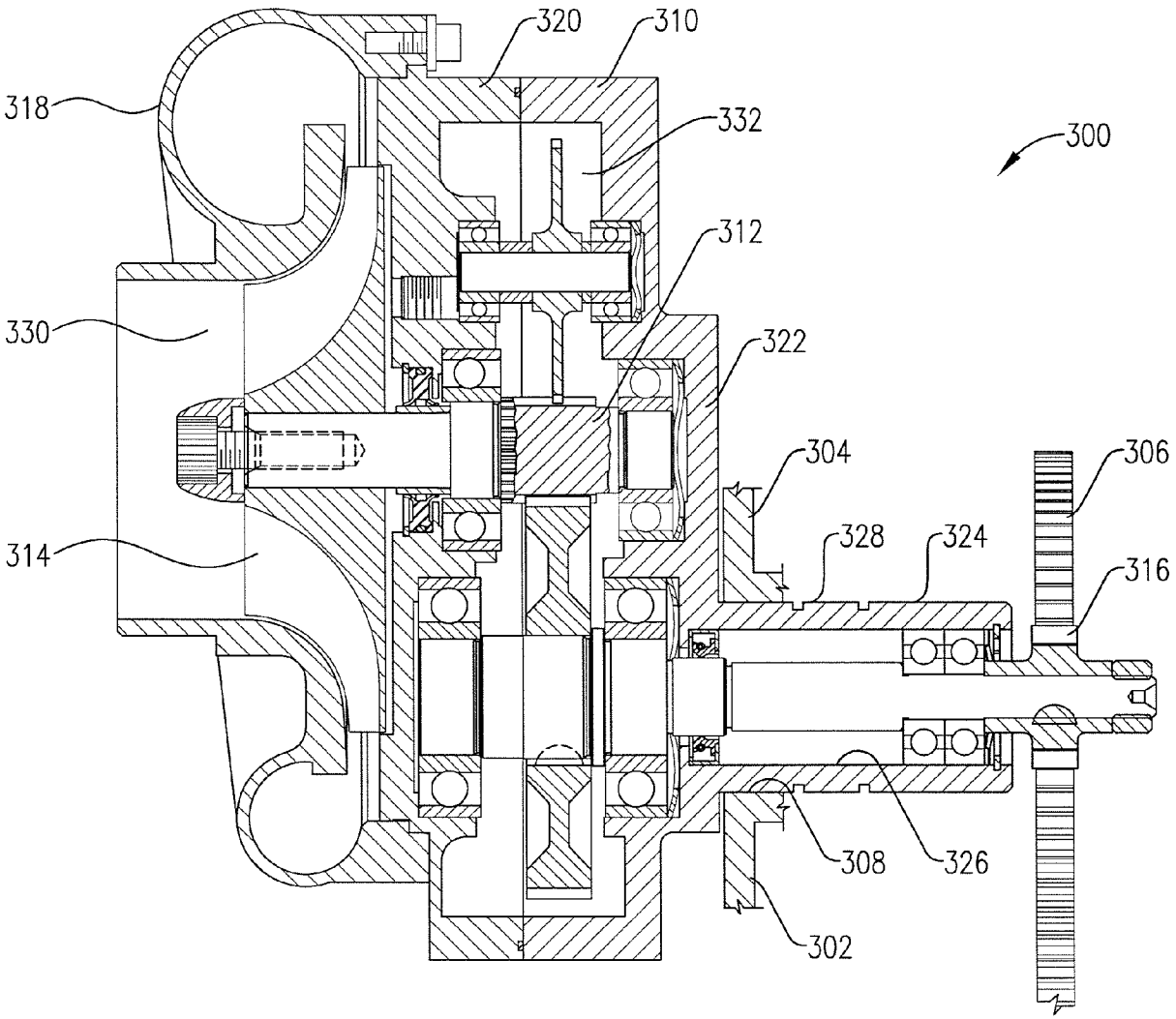
Figure 13:
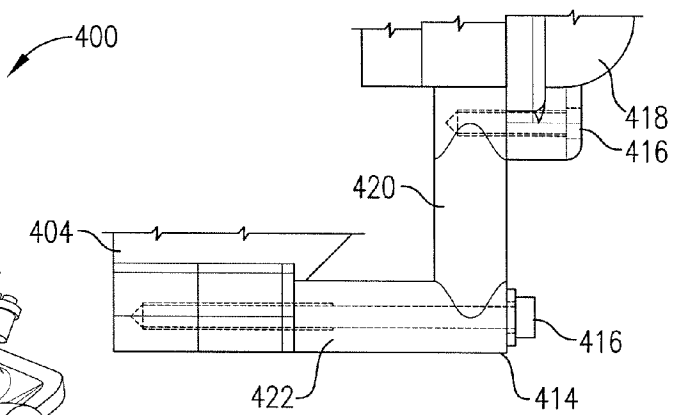
Figure 12:
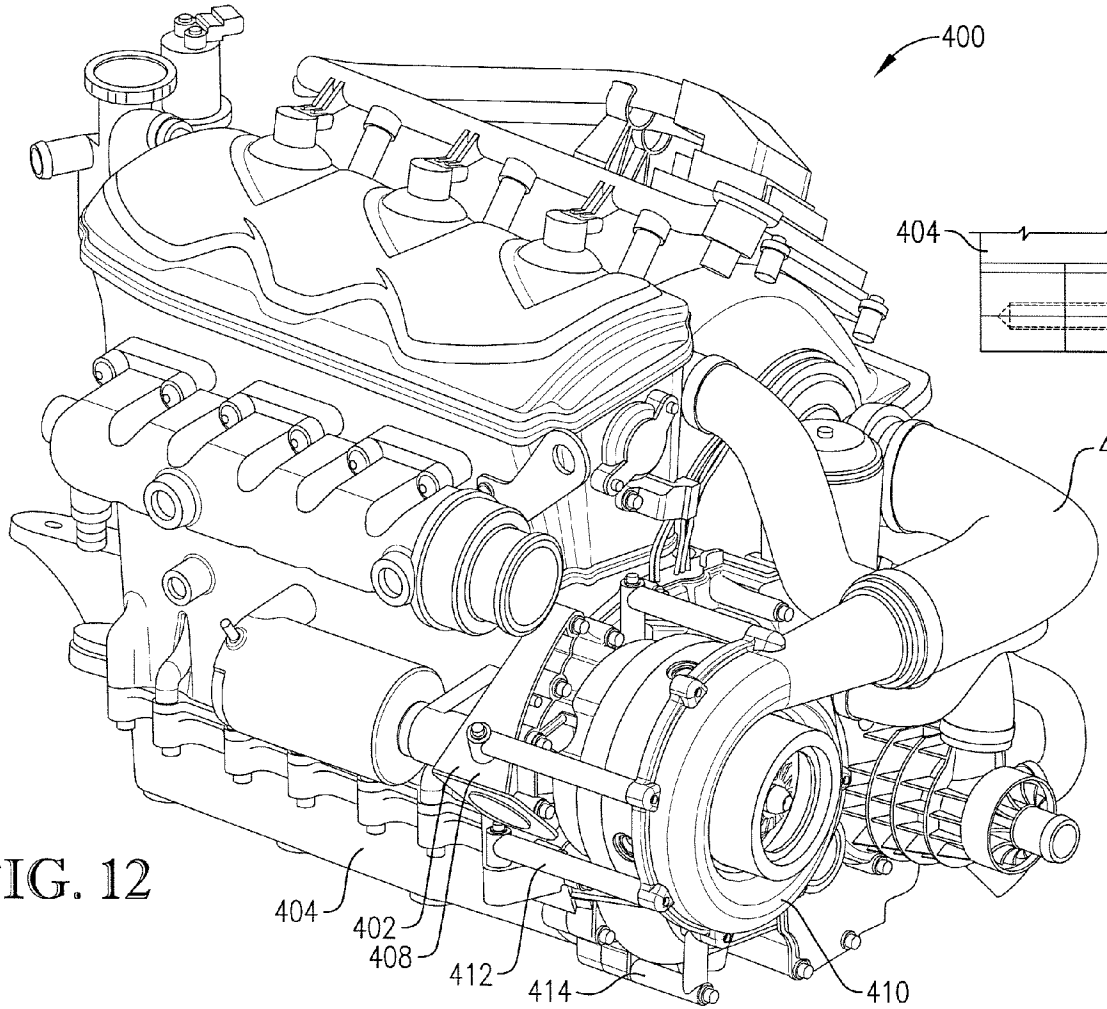

FIG. 10 is an exploded view of a second preferred supercharger including an internal step-up transmission and a rotatable supercharger case insert;

FIG. 11 is a cross-sectional view of a third preferred supercharger including an alternative supercharger case;

FIG. 12 is a fragmentary rearward perspective view of another preferred personal watercraft, showing a second preferred supercharged engine with a fourth preferred supercharger mounted thereon; and FIG. 13 is a greatly enlarged elevational view of the preferred personal watercraft, showing the supercharger being mounted to the engine along a lowermost supercharger margin by a unitary bracket having an upstanding bracket leg that is configured to space the bracket from the engine.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

FIGS. 1 and 5 illustrate a forced air induction system 100 that includes a supercharger 102 constructed in accordance with a preferred embodiment of the present invention. The induction system 100 provides compressed induction fluid to an engine 104, with the engine 104 and induction system 100 cooperatively providing a supercharged engine that is incorporated into a personal watercraft 106. As will be discussed in greater detail, the illustrated personal watercraft 106 is preferably arrived at by installing one of the disclosed supercharger embodiments onto a pre-existing craft as an aftermarket modification. However, the principles of the present invention are applicable where the personal watercraft 106 is manufactured entirely as original equipment. Also, it is within the ambit of the present invention that the illustrated supercharger embodiments are applicable for use with various types of engine-powered vehicles, such as motorcycles, all-terrain vehicles, automobiles, and other types of waterborne craft. The personal watercraft 106 broadly includes a hull 108, the engine 104, a watercraft drive mechanism 110, and the forced air induction system 100.

Referring to FIGS. 1, 5, and 6, the hull 108 includes an outermost shell 112 and motor mounts 114 for receiving the engine 104 thereon. The watercraft drive mechanism 110 includes a screw propeller 116 positioned at the rear of the watercraft 106 and a drive shaft 118 that drivingly interconnects the propeller 116 and the engine 104.

The engine 104 includes an engine block 120, a power-take-off housing 122, a crankshaft 124, a flywheel ring gear 126, a magneto 128, and a starter assembly 130. The engine block 120, as is known by those skilled in the art, has the crankshaft 124 rotatably mounted therein with the ring gear 126 being mounted onto the crankshaft 124 (see FIG. 8*b*) and external to the block 120. The starter assembly 130 is mounted on the engine block 120 and includes a starter motor 132 and gear train 133 that drivingly interconnects the starter motor 132 and ring gear 126. Additional details of a similar preferred watercraft are disclosed in co-pending U.S. patent application No. 11/161,450, filed Aug. 3, 2005, entitled PERSONAL WATERCRAFT FORCED AIR INDUCTION SYSTEM, which is hereby incorporated by reference herein.

The power-take-off housing 122 is an open-ended cover section and includes a socket 134 spaced oppositely from an open end 136. The socket 134 provides an opening in the housing 122, the purpose of which will be discussed in greater detail. The housing 122 is arranged with the open end 136 spaced adjacent to the block 120 and is rigidly mounted onto the engine block 120. The installed housing 122 extends around and substantially covers the ring gear 126, magneto 128, and portions of the starter assembly 130. The socket 134 presents a substantially cylindrical inner mating surface 138 and a socket central axis $A_{sc}$ (see FIG. 8*b*). However, the principles of the present invention are applicable where the socket 134 includes alternative mating surfaces, either internal or external, for mating with any of the various preferred supercharger embodiments disclosed herein.

Turning to FIG. 5, the forced air induction system 100 broadly includes the supercharger 102 and a conduit 140. The conduit 140 fluidly communicates with the supercharger 102 and an engine intake 142 and thereby permits compressed induction fluid to be forced from the supercharger 102 and into the engine 104. The principles of the present invention are also applicable where the forced air induction system 100 includes other components, such as an intercooler for cooling the charge of incoming induction fluid. One exemplary forced air induction system that includes an intercooler and is designed for use on a powered vehicle is disclosed in co-pending U.S. patent application Ser. No. 10/605,880, filed Nov. 3, 2003, entitled SUPERCHARGED MOTORCYCLE, which is hereby incorporated by reference herein.

Turning to FIGS. 5, 6, 7, 8*b*, and 9, the supercharger 102 broadly includes a supercharger case 144, a rotatable impeller 146, input shaft 148, and input gear 150. The supercharger case 144 includes case sections 152,154,156,158. Case sections 152 and 156 are fastened together, with case section 154 being secured within an open end of case section 156. In this manner, case sections 152,154,156 cooperatively present a compression chamber 160. Case sections 154,156 cooperatively present a shaft-enclosing chamber 162. Case sections 156,158 are fastened relative to each other. Case section 158 provides a mounting plate for attaching the supercharger case 144 to the engine 104.

Case section 156 presents a projection portion 164 that, when the case 144 is assembled, extends away from the remainder of the case 144. The projection portion 164 presents a cylindrical outer projection surface 166 and a projection central axis $A_p$ defined by the outer projection surface 166. The projection portion 164 also presents a cylindrical inner projection surface 168 with a central axis that is not aligned with the projection central axis $A_p$. In other words, the surfaces 166,168 define a wall thickness of the projection portion 164 that varies around the projection circumference, as illustrated by the wall thicknesses T1,T2, with T1 being greater than T2. It is also consistent with the principles of the present invention that the projection portion 164 could have various alternative inner and outer surface shapes.

The case 144 receives a compound bearing assembly 170 and ball bearings 172 therein. In particular, the case section 156 receives the bearing assembly 170 adjacent the open end of the case section 156 and bearings 172 are received therein adjacent an opposite end of the case section 156. The compound bearing assembly 170 also includes nested ball bearings 174 and is particularly suited for supporting the input shaft 148 at very high rotational speeds. Additional details of the preferred bearing assembly 170 are disclosed in U.S. Pat. No. 6,478,469, issued Nov. 12, 2002, entitled VELOCITY VARIANCE REDUCING MULTIPLE BEARING ARRANGEMENT FOR IMPELLER SHAFT OF CENTRIFUGAL SUPERCHARGER, which is hereby incorporated by reference herein.

The input shaft 148 is substantially unitary and includes opposite ends 176 and presents an input shaft axis $A_{is}$. The input gear 150 is a spur gear and preferably includes about 14 teeth. The input shaft 148 is received within the case 144. The impeller 146 is mounted onto the input shaft 148 adjacent one of the shaft ends 176 and the input gear 150 is mounted adjacent to another of the shaft ends 176. Thus, the impeller 146 and input gear 150 rotate concurrently. However, as will be illustrated in other preferred supercharger embodiments, the principles of the present invention are applicable where the impeller 146 and input gear 150 are drivingly interconnected but are mounted on separate shafts. Furthermore, while the illustrated supercharger 102 is effectively "transmissionless," i.e., the supercharger 102 does not include an internal, dedicated transmisssion step-up, other embodiments will be disclosed that do include an internal transmission for further increasing the impeller's rotational speed.

The input shaft axis $A_{is}$ is not aligned with the projection central axis $A_p$, as shown in FIG. 8*b*. Rather, the axes $A_{is}$,$A_p$ are offset from each other a distance D, due to the relative position of surfaces 166,168. As will be discussed, the illustrated offsetting arrangement of the input shaft 148 and the projection portion 164 particularly enables the driving interengagement of the supercharger 102 and engine 104.

The supercharger 102 is drivingly interconnected with the engine 104 by positioning the projection portion 164 within the socket 134 and with the input gear 150 intermeshing with the ring gear 126. As will be discussed, the present invention is particularly suited for aftermarket modification of the illustrated gear drive train that drivingly interconnects the supercharger 102 and engine 104. However, it is within the ambit of the present invention to modify other originally-installed drive mechanisms, such as chain-and-sprocket or belt-and-sheave arrangements. It is also consistent with the principles of the present invention that the illustrated drive mechanism, i.e., the input gear 150 and ring gear 126, may include alternative drive components, such as chain-and-sprocket or belt-and-sheave arrangements that serve to drivingly interconnect the supercharger 102 and engine 104 and provide a transmission step-up.

The supercharger 102 is supported by the interengagement of the projection portion 164 and the socket 134. In this position, the socket central axis $A_{sc}$ and the projection central axis $A_p$ are substantially aligned (see FIG. 8*b*). The supercharger 102 is further secured onto the engine 104 by extending multiple fasteners (not shown) through bosses 178 of the case 144.

As mentioned above, the preferred supercharger 102 is particularly suited for being installed as an aftermarket supercharger, where the engine 104 is an original-equipment engine. However, the principles of the present invention are applicable where the supercharger 102 and engine 104 are provided as an original-equipment supercharged engine.

Where the supercharger 102 is installed as aftermarket equipment, the supercharger 102 may replace an original-equipment supercharger (not shown). One advantage of replacing the original-equipment supercharger, is that the supercharger 102 is capable of operating at higher rotational speeds and can, therefore, generate higher boost pressures. The original-equipment supercharger may be variously configured, but it is required to include a supercharger case portion (similar to the projection portion 164) that is complementally received within the socket 134 and an original input gear that drivingly intermeshes with the ring gear 126. For example, the original-equipment supercharger may be configured similarly to the prior art supercharged engine as shown in FIG. 8*a*, with the original input gear and supercharger case portion being axially aligned.

In order for the supercharger 102 to replace the above-noted original-equipment supercharger, the supercharger 102 must be installed so that the gear train of the preferred embodiment is intermeshing. In a preferred approach, the supercharger 102 achieves higher rotational speeds than the original-equipment supercharger where the input gear 150 includes a smaller pitch diameter than the original input gear (not shown). Thus, the gear ratio between input gear and ring gear 126 is effectively increased by reducing the size of the input gear 150. The original input gear (not shown) includes 17 teeth and the illustrated ring gear 126 includes 86 teeth. Thus, the original gear ratio is 86:17, or about 5:1. As discussed above, the input gear 150 preferably includes about 14 teeth. Thus, a preferred modified gear ratio is about 86:14, or about 6:1. In other words, the gear ratio is preferably increased from a range of about 4:1 to 6:1, to a range of about 5:1 to 7:1. So where the engine originally generates an output speed of about 7600 rpm, the supercharger output speed increases from about 38,000 rpm, as originally configured, to about 46,000 rpm with the new input gear 150. Again, the principles of an offset supercharger input axis may also be applicable where a sprocket-and-chain assembly or a belt-and-sheave assembly is used to drivingly interconnect the supercharger 12 and the engine 14.

In operation, the supercharger 102 is configured to replace the previously mounted original-equipment supercharger. Initially, the original-equipment supercharger is removed from the engine 104 by removing fasteners (not shown) that secure the supercharger to the engine 104. The original-equipment supercharger is then shifted out of engagement with the socket 134. The supercharger 102 is then mounted onto the engine 104 by inserting the projection portion 164 into mating engagement with the socket 134. Suitable seals (similar to the original equipment) may be used. Furthermore, the supercharger 102 is positioned so that the ring gear 126 and input gear 150 are intermeshing. The supercharger 102 is secured to the engine 104 with various fasteners as discussed above.

Turning to FIGS. 10-13, alternative preferred embodiments of the present invention are depicted. For the sake of brevity, the remaining description will focus primarily on the differences of these alternative embodiments from the preferred embodiment described above.

Initially turning to FIG. 10, an alternative supercharger 200 is constructed in accordance with a second embodiment of the present invention. The supercharger 200 broadly includes an alternative supercharger case 202, an internal step-up transmission 204, an impeller 206, and a case insert assembly 208.

The case 202 includes case sections 210,212,214. The sections 210 and 212 cooperatively form a compression chamber (not shown). The sections 212 and 214 cooperatively form a transmission chamber (not shown) for receiving and enclosing the transmission 204 therein. Additional details of the alternative case 202 are disclosed in co-pending U.S. patent application No. 11/307,945, filed Feb. 28, 2006, entitled WET BELT SUPERCHARGER DRIVE FOR MOTORCYCLE, which is hereby incorporated by reference herein.

The case insert assembly 208 prevents catastrophic failure of the impeller 206. Additional details concerning the preferred case insert assembly 208 are also disclosed in the above-referenced Application No. 11/307,945.

The internal step-up transmission 204 includes an input shaft 220 and an impeller shaft 222 that are rotatably mounted within the case 202 on various bearings 224. The impeller 206 is mounted on the impeller shaft 222 and spaced within the compression chamber. The transmission 204 further includes a drive gear 226, a driven gear 228, and a slinger 230, all of which are spaced within the transmission chamber. The drive gear 226 is mounted on the input shaft 220 and the driven gear 228 is mounted on the impeller shaft 222. The gears 226,228 are intermeshing and thereby drivingly interconnect the input shaft 220 and the impeller 206. Additional details of the preferred transmission 204 are disclosed in U.S. Pat. No. 6,439,208, issued Aug. 27, 2002, entitled CENTRIFUGAL SUPERCHARGER HAVING LUBRICATING SLINGER, which is hereby incorporated by reference herein.

The supercharger 200 further includes an input gear 232 mounted on the input shaft 220. Similar to the input gear 148, the input gear 232 is configured to intermesh with a ring gear (not shown). Furthermore, the case section 214 includes a cylindrical projection portion 234, similar to the preferred embodiment, for being received within and mounted to a complemental engine case socket (not shown). However, in this embodiment, the input shaft 220 and projection portion 234 are axially aligned, although this relationship is not required.

Turning to FIG. 11, an alternative supercharger 300 is constructed in accordance with a third embodiment of the present invention. The supercharger 300 is mounted on an engine 302. The engine 302 includes a housing 304 and a ring gear 306 mounted on the crankshaft (not shown). The housing 304 presents a socket 308.

The supercharger 300 includes an alternative case 310, an internal step-up transmission 312, an impeller 314, and an input gear 316. The transmission 312 and impeller 314 are operably housed within the case 310 and are substantially similar to the previous transmission embodiment. The case 310 includes sections 318,320,322, with section 322 including an alternative projection portion 324. The projection portion 324 includes inner and outer surfaces 326,328 that are substantially axially aligned. The sections 318 and 320 cooperatively form a compression chamber 330. The sections 320 and 322 cooperatively form a transmission chamber 332 that receives the transmission 312 therein. Additional details of a preferred supercharger with an internal step-up transmission are disclosed in the above-referenced U.S. Pat. No. 6,439,208. The supercharger 300 is very similar to the supercharger 200, but does not include several components, such as the insert assembly 208.

Turning to FIGS. 12 and 13, an alternative personal watercraft 400 is constructed in accordance with a fourth embodiment of the present invention. The watercraft 400 includes a hull 402, an engine 404, and a forced air induction system 406. The hull 402 includes a motor mount 408. The forced air induction system 406 includes a supercharger 410 that is similar in construction in many respects to the supercharger 102. However, the supercharger 410 is mounted to the engine 404 and the motor mount 408 with various brackets 412. The brackets 412 include an L-shaped bracket 414 that is fastened by fasteners 416 and thereby interconnects a lowermost margin of a supercharger case 418 to the engine 404. The bracket 414 is unitary and includes an upstanding leg 420 that permits the bracket 414 to extend vertically below the case 418. The bracket 414 further includes a laterally-extending sleeve portion 422 that is fixed to the leg 420 and is thereby spaced from the engine 404. In this manner, the bracket 414 provides greater leverage than the remaining brackets 412 in restricting off-axis lateral movement of the supercharger 410 relative to the engine 404. Because a good portion of the supercharger 410 is otherwise supported in a cantilevered fashion by the socket and projection (both not shown), the brackets 412 (and particularly the bracket 414) are especially useful in reducing the risk of supercharger deflection relative to the engine. Those of ordinary skill in the art will appreciate that personal watercraft can experience several times the force of gravity during normal use and any consequential supercharger shaft deflection could be catastrophic. It has been determined that the brackets 412 prevent such deflection and dramatically improve supercharger life.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A personal watercraft comprising:

a buoyant hull configured to support at least one rider thereon, said hull defining an interior space;

an engine including an intake and a supercharger mounting socket, said engine being mounted within the interior space, said engine including a crankshaft and a crankshaft drive gear mounted thereon; and a supercharger operable to supply supercharged induction fluid to the intake, said supercharger comprising:

a case presenting a compressor chamber, said case including a projection received within the mounting socket, a rotatable compression member within the compressor chamber, and a rigid, integral bracket presenting opposite first and second ends and a central elongated section therebetween, said first end of the bracket being fixed relative to the engine, said second end of the bracket being fixed to the case at an attachment location spaced from the projection, with the central section configured to be spaced from the engine and the case portion, said supercharger including a rotatable input shaft mounted on the case, said rotatable input shaft carrying an input gear drivingly connected to the crankshaft drive gear, said projection presenting a distal end adjacent the crankshaft drive gear, said input gear being spaced outwardly beyond the distal end.

2. The personal watercraft as claimed in claim 1, said input gear drivingly intermeshing with said crankshaft drive gear.

3. The personal watercraft as claimed in claim 1, said rotatable input shaft extending through the projection and being operable to rotate therein.

4. The personal watercraft as claimed in claim 3, said engine including a power-take-off housing, with the supercharger mounting socket being formed therein.

5. The personal watercraft as claimed in claim 3, said case including a portion thereof that defines the compressor chamber, said projection extending laterally relative to said case portion, with the projection and mounting socket cooperatively mounting the case portion in a cantilevered relationship relative to the engine.

6. The personal watercraft as claimed in claim 3, said case presenting a transmission chamber, a step-up transmission located at least partly within the transmission chamber and including a rotatable input shaft, a compression member shaft with the compression member mounted thereon, a drive element associated with the input shaft, and a driven element associated with the compression member shaft, said drive element having a larger diameter than the driven element, with the relative diameters defining a diameter ratio of the step-up transmission.

7. The personal watercraft as claimed in claim 3, said central section being at least partly upright in orientation.

8. The personal watercraft as claimed in claim 1, said compression member being mounted on the rotatable input shaft.

9. The personal watercraft as claimed in claim 8, said compression member being a rotatable impeller.

10. A personal watercraft comprising:

a buoyant hull configured to support at least one rider thereon, said hull defining an interior space;

an engine including an intake and a supercharger mounting socket, said engine being mounted within the interior space, said engine including a crankshaft and a crankshaft drive gear mounted thereon; and a supercharger mounted to the engine for providing supercharged induction fluid to the intake, said supercharger including a case presenting a compressor chamber and a transmission chamber, said case including a projection received within the supercharger mounting socket, a rotatable compression member located within the compressor chamber, and a step-up transmission located at least partly within the transmission chamber and including a rotatable input shaft, a rotatable compression member shaft with the compression member mounted thereon, a drive element associated with the input shaft, and a driven element associated with the compression member shaft, said shafts being supported on the case, said drive element having a larger diameter than the driven element, with the relative diameters defining a diameter ratio of the step-up transmission, said rotatable input shaft being mounted on the case, said rotatable input shaft carrying an input gear drivingly connected to the crankshaft drive gear, said projection presenting a distal end adjacent the crankshaft drive gear, said input gear being spaced outwardly beyond the distal end.

11. The personal watercraft as claimed in claim 10, said drive element being a transmission drive gear and said driven element being a transmission driven gear.

12. The personal watercraft as claimed in claim 11, said transmission drive gear drivingly intermeshing with the transmission driven gear.

13. The personal watercraft as claimed in claim 11, said transmission drive and driven gears being mounted respectively onto the input and compression member shafts.

14. The personal watercraft as claimed in claim 10, said engine including a power-take-off housing, with the supercharger mounting socket being formed therein.

15. The personal watercraft as claimed in claim 10, said input gear drivingly intermeshing with said crankshaft drive gear.

16. The personal watercraft as claimed in claim 10, said rotatable input shaft extending through the projection and being operable to rotate therein.

17. The personal watercraft as claimed in claim 16, said case including a portion thereof that defines the compressor chamber, said projection extending laterally relative to said case portion, with the projection and mounting socket cooperatively mounting the case portion in a cantilevered relationship relative to the engine.

18. The personal watercraft as claimed in claim 17; and a rigid, integral bracket presenting opposite first and second ends and a central elongated section therebetween, said first end of the bracket fixed relative to the engine, said second end of the bracket being fixed to the case portion at an attachment location spaced from the projection, with the central section spaced from the engine and the case portion.

19. The personal watercraft as claimed in claim 10, said compression member being a rotatable impeller.

* * * * *